US005937783A

United States Patent [19]

Costa

[11] Patent Number: 5,937,783

[45] Date of Patent: Aug. 17, 1999

[54] CARRIER SYSTEM FOR INFLATABLE DINGHY

[76] Inventor: Kevin R. Costa, 19 Cranberry La., Swansea, Mass. 02777

[21] Appl. No.: 09/027,462

[22] Filed: Feb. 21, 1998

[51] Int. Cl.[6] ..... B63B 23/04

[52] U.S. Cl. ..... 114/259; 114/373

[58] Field of Search ..... 114/259, 373, 114/368, 364, 190, 343, 366; 441/81

[56] References Cited

U.S. PATENT DOCUMENTS

| | | | |
|---|---|---|---|
| 3,099,845 | 8/1963 | Chamberlain | 441/81 |
| 4,033,276 | 7/1977 | Barr | 441/81 |
| 4,964,358 | 10/1990 | Sandrow | 114/368 |
| 5,170,742 | 12/1992 | Roskelley | 114/366 |
| 5,193,479 | 3/1993 | Bielefeld | 114/366 |

*Primary Examiner*—Sherman Basinger
*Attorney, Agent, or Firm*—Robert J Doherty

[57] ABSTRACT

A boat lift and carrier device for receiving and grasping one of the pontoon portions of an inflatable dinghy including preferably a pair of laterally spaced generally C-shaped hoop carriers having a pocket to receive at least part of the pontoon portion through a channel of a dimension slightly less than the diameter of the pontoon portion such that the aforementioned grasping action is brought about at least while initially positioning the pontoon onto the lift and carrier device.

6 Claims, 5 Drawing Sheets

CARRIER SYSTEM FOR INFLATABLE DINGHY

FIELD OF THE INVENTION

This invention relates to devices used to support and carry small lightweight boats and particularly inflatable dinghies generally from the stern of a larger boat and more usually from the swim platform thereof.

BACKGROUND AND OBJECTS OF THE INVENTION

Small inflatable boats or dinghies are in commonplace use in conjunction with larger vessels or boats so that the users thereof may conveniently access and leave the larger vessel without the need of docking facilities and the like; and, accordingly, it is common to store these dinghies or inflatables as they are commonly referred to at the rear transom or swim platform of the larger vessel on which they are utilized in conjunction with. Various systems have, accordingly, been devised to store the inflatables when not in use including when the larger vessel is in under way and include such systems as shown in the following representative U.S. patents, namely, U.S. Pat. No. 4,864,951 to Koept Jr. issued Sep. 12, 1989; U.S. Pat. No. 5,170,742 issued Dec. 15, 1992 to Roskelley; and U.S. Pat. No. 5,193,479 to Bielefeld issued Mar. 16, 1993.

Most of the devices now in use utilize some type of arm or enveloping line or member which, in essence, cradles one or both opposed longitudinally oriented and laterally separated pontoons of the inflatable and thus enables the dinghy to be positioned on the rear of the vessel or on the swim platform and then lifted to an elevated position thereat for storage. The above cited patents are representative of this general state of the art.

SUMMARY OF THE INVENTION

The present inventor has devised a system which more simply and less expensively accomplishes the general objects of the invention including more easily enabling the inflatable to be positioned on the swim platform or otherwise and more simply and securely position by the device in both the non elevated and elevated positions thereof. These and other objects of the present invention are accomplished by a boat lift and carrier device for inflatable boats of the type having an opposed pair of laterally spaced longitudinally oriented pontoon portions separated by having inboard and outboard pontoon portions of a generally cylindrical configuration having a diametric measurement of a first length, said device including a pair of carrier hoops each mounted in a bracket for pivotal movement with respect to said bracket between a first loading position and a second storage position, said hoops each including an upper and a lower arm and a connecting base portion, said arms outwardly extending from said base portion and terminating in respective forward terminal ends which are spaced from each other a distance slightly less than that of the said pontoon portion first length diametric measurement to form an entrance channel for said pontoon portion, said arms of each hoop cooperatively forming a receiving pocket between said arms and in communication with said entrance channel and of a generally cylindrical configuration and having a diametric measurement of a second length at least equal to that of said first length for receiving said pontoon portions, and means for attaching a line to each of the lower arms so as to pivot said arms about said brackets between said first and second positions after the inboard pontoon portion of said inflatable boat has been positioned in said receiving pockets.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
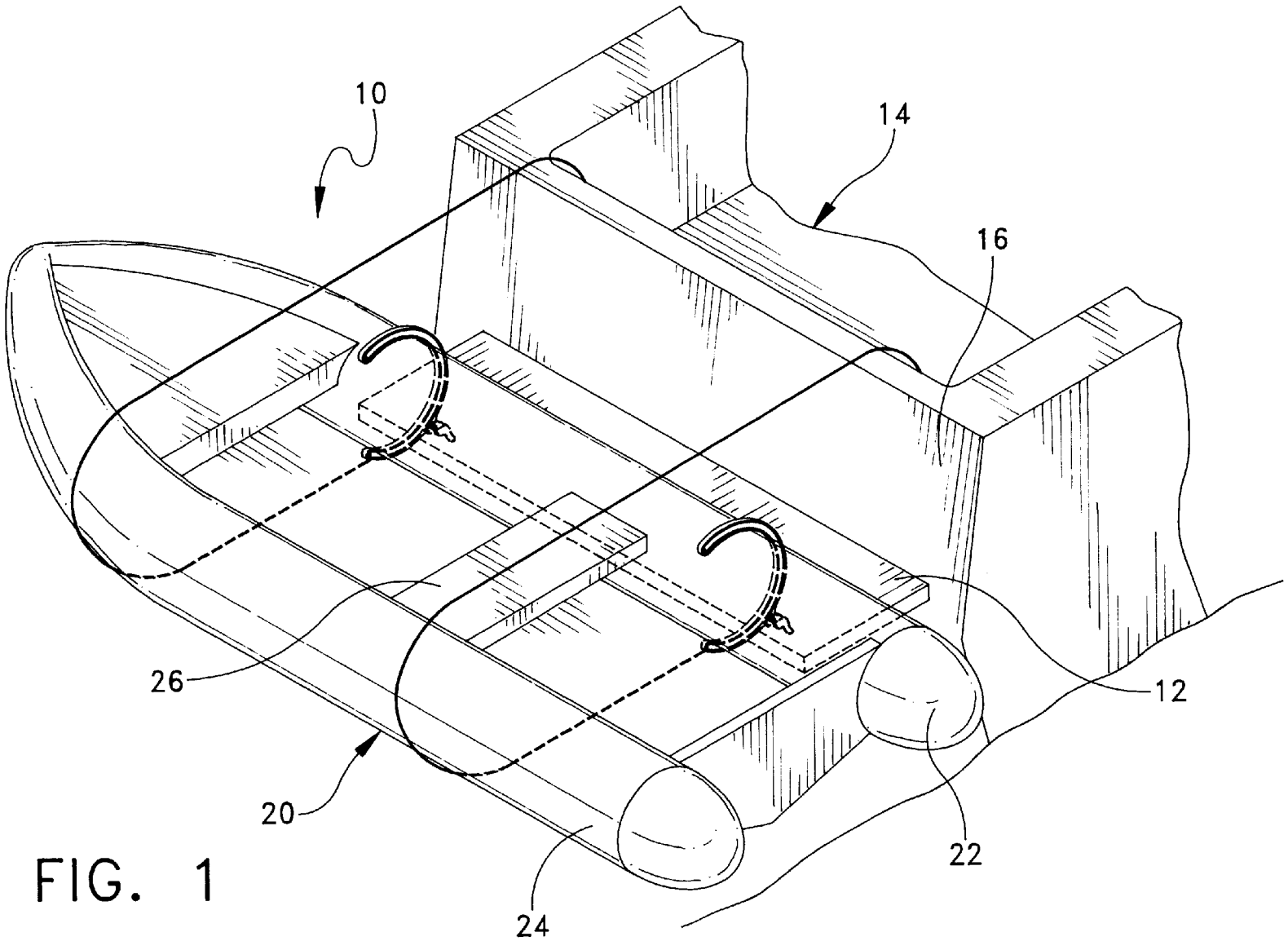
FIG. 1 is a perspective view illustrating in a somewhat schematic manner how the device of the present invention is utilized in conjunction with the swim platform of a larger vessel so as to receive the inboard pontoon of an inflatable dinghy.

As best shown in FIG. 1 of the drawings, the lift device 10 of the present invention is primarily intended for attachment to the upper surface of the swim platform 12 of a larger vessel 14 at the stern 16 thereof. The device 10 is particularly adapted for the receipt and ultimate storage in an elevated position of an inflatable dinghy 20 of the type having a pair of laterally separated pontoons, that is, an inboard pontoon 22 and an outboard pontoon 24, separated by some type of hull web or occupant support 26. It should be brought out that while such a boat is referred to throughout the specification as an inflatable or a dinghy and having pontoon portions, in fact, such dinghy may be of a singular hull construction rather than having two separate pontoons and, accordingly, the term "pontoon portion" will be utilized to so generically describe that area or general portion of the inboard pontoon that is received by the device 10 of the present invention.

Figure 5:
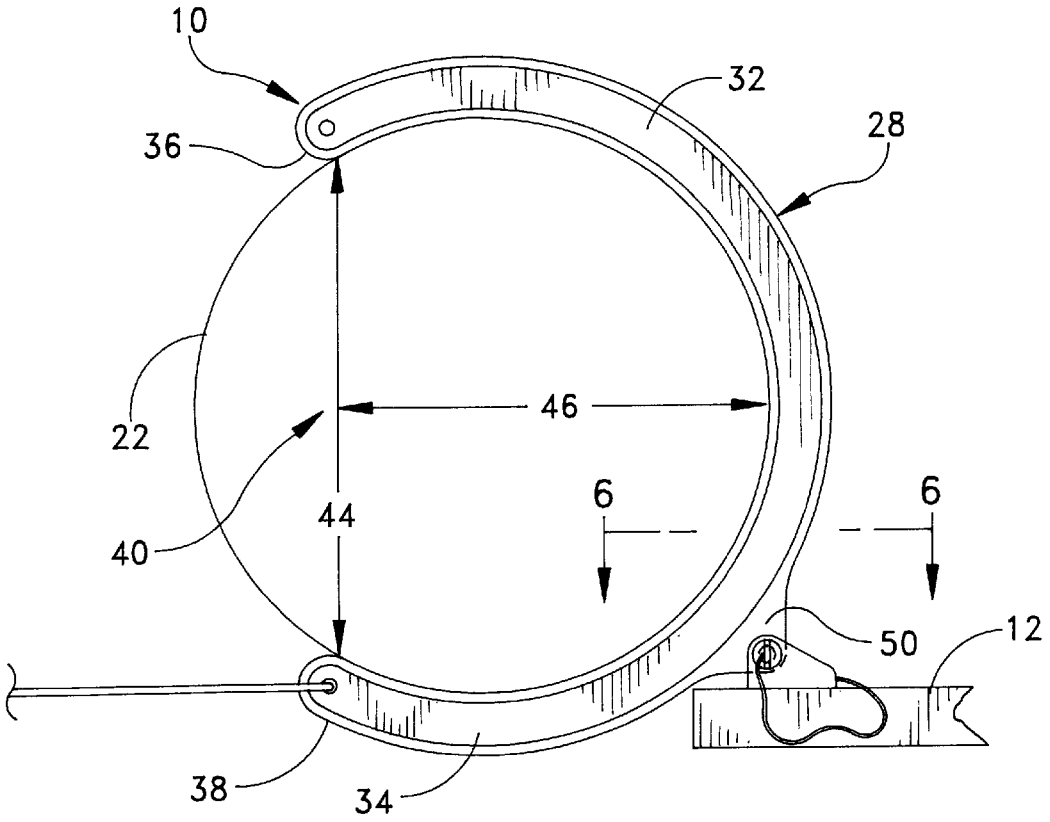
FIG. 5 is an enlarged side elevational view of one of the hoop carriers of the present invention shown mounted in a pivotal position on a bracket in turn mounted on the swim platform of a larger vessel.
Figure 6:
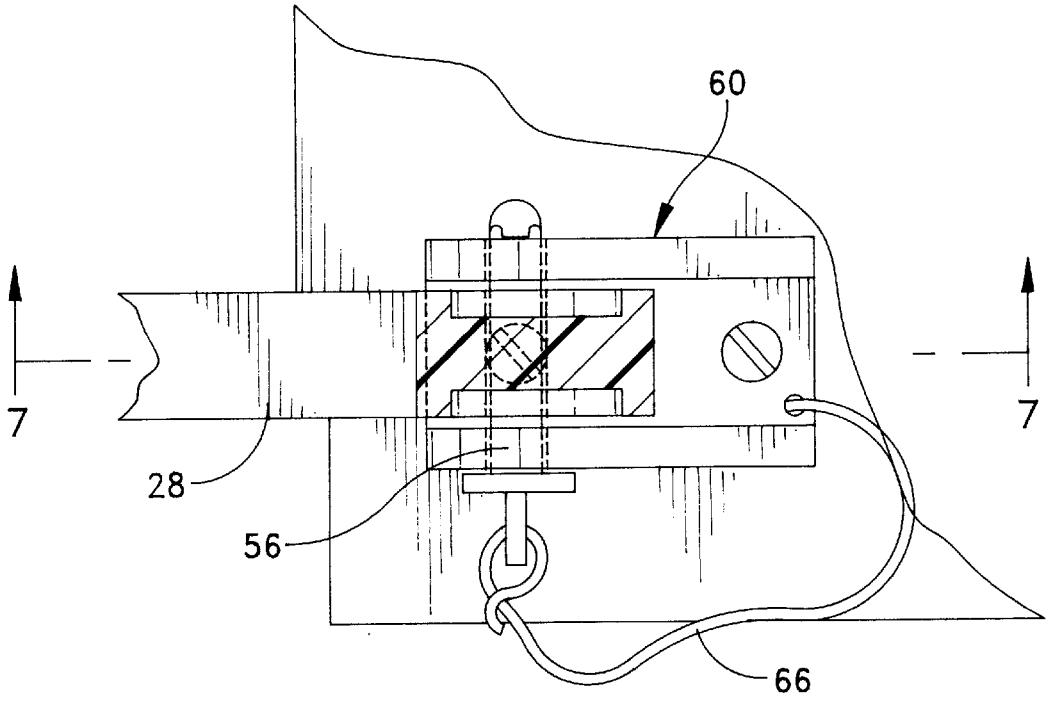
FIG. 6 is a top sectional view taken along the line 6—6 of FIG. 5.
Figure 8:
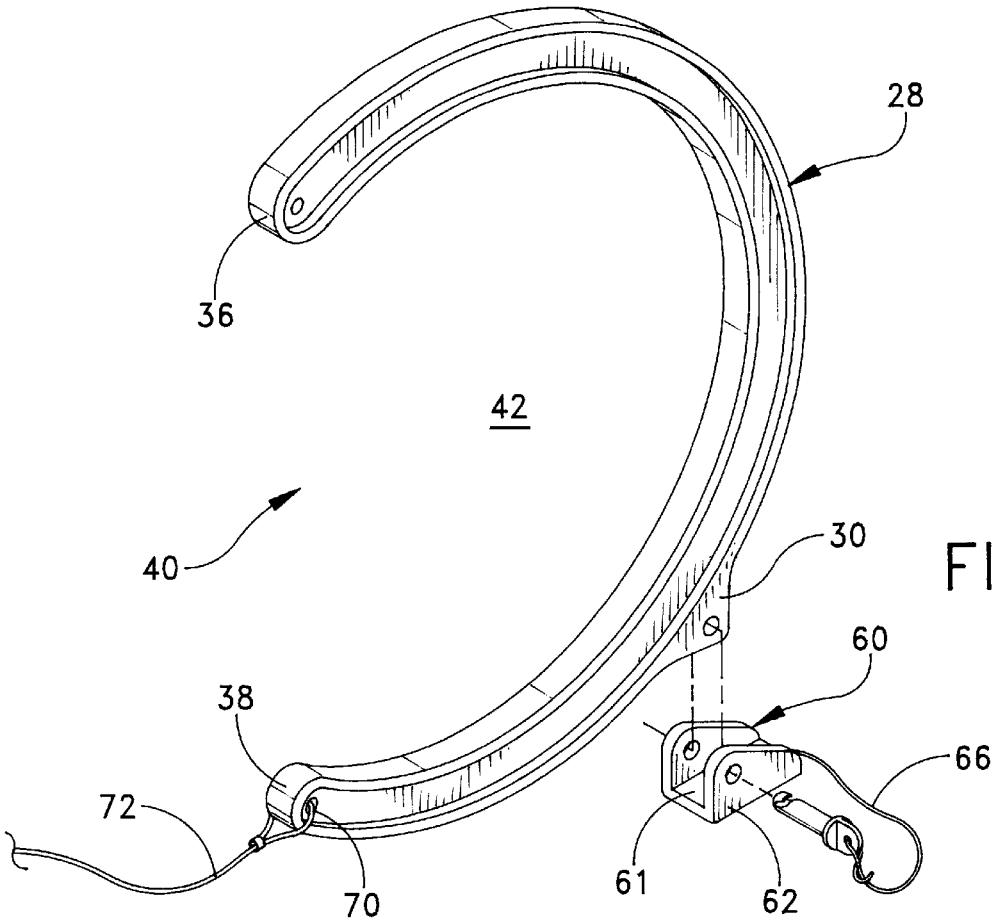
FIG. 8 is an exploded perspective view showing the manner in which the base of one of the hoop carriers of the present invention is supported for pivotal movement within the bracket.

Such device 10, in essence, and as best shown by FIGS. 5 and 8 of the drawings comprises a pair of generally C-shaped carrier hoops 28 preferably made of a high strength smooth, engineered plastic material such as polypropylene, nylon or the like and capable of supporting the weight of the dinghy and also capable of withstanding the corrosive effects of a salt water environment in which the invention would be generally used. Other materials including metals such as aluminum or even wood can be utilized.

Each of the hoop carriers 28 includes a base or heel portion 30 from which a pair of forwardly extending curved arms extend. The upper and lower arms 32 and 34 respectively terminate at their forward ends 36 and 38 at points vertically separated from each other a distance slightly less than the diameter of the pontoon portions which are to be engaged therewith in the manner as shown in FIG. 1 and furthermore cooperatively form a receiving channel 40 of such dimension. This dimensioning is purposeful such that when the hoop carriers 28 are laterally mounted in spaced relationship from each other on the upper surface of the swim platform as shown in FIG. 1 that the person either on the swim platform or in the water adjacent thereto can simply push the dinghy into engagement with the hoop carriers 28 by positioning the inboard pontoon 22 adjacent the entrance channel 40 and thence through such channel into a receiving pocket 42 extensive therewith and of a diameter either equal to or slightly greater than that of the diameter of the inboard pontoon portion which in turn is equal to the diametric measurement of a first length as above described. Once the dinghy has been so positioned by the person or persons manipulating such, it is thus frictionally grasped by the arm ends 36, 38 unlikely that it will float out of contact with the hoop carriers. This grasping action enables the person or persons storing the inflatable to climb aboard the vessel and from the stern thereof and as best depicted in the transition between FIGS. 2 through 4 elevate the boat lift mechanism of the present invention from its initial first position wherein the dinghy is in a floating horizontal position vis-a-vis the water to an elevated position at the stern of the boat.

Figure 2:
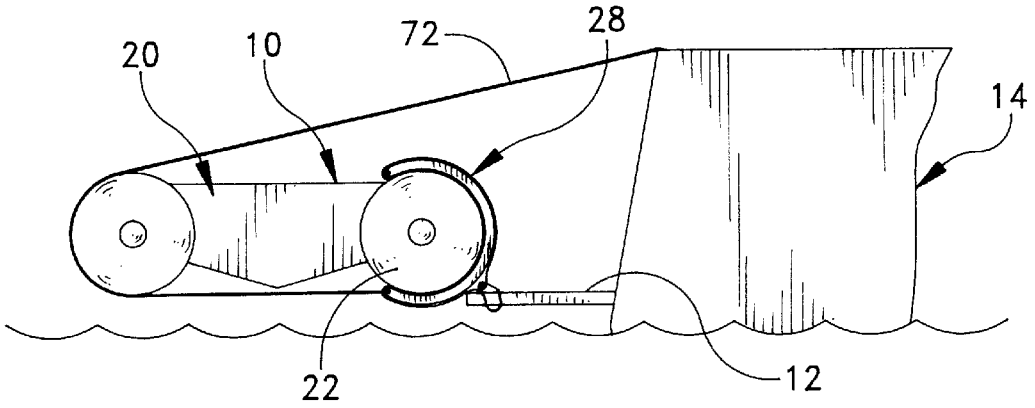
FIG. 2 is a right side view of the arrangement shown in FIG. 1.
Figure 3:
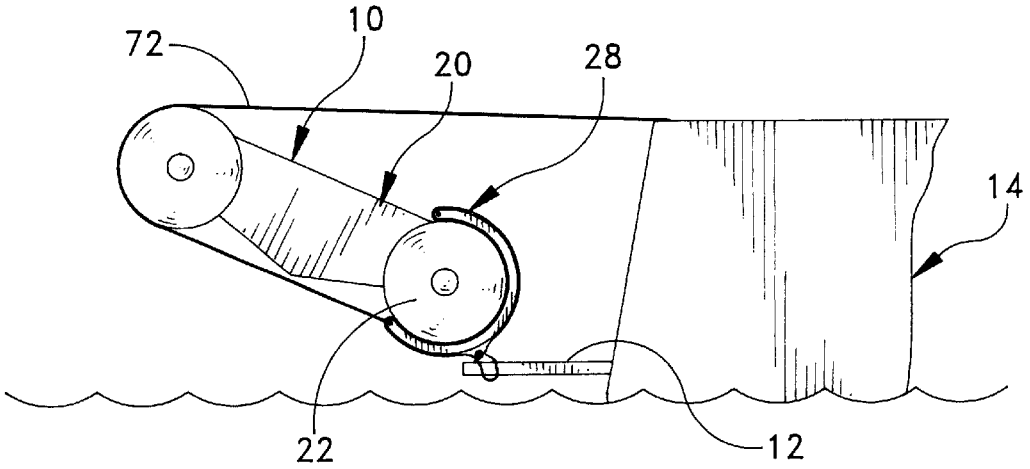
FIG. 3 is a view similar to FIG. 2 but showing the device partially pivoted upwardly in a clockwise movement.
Figure 4:
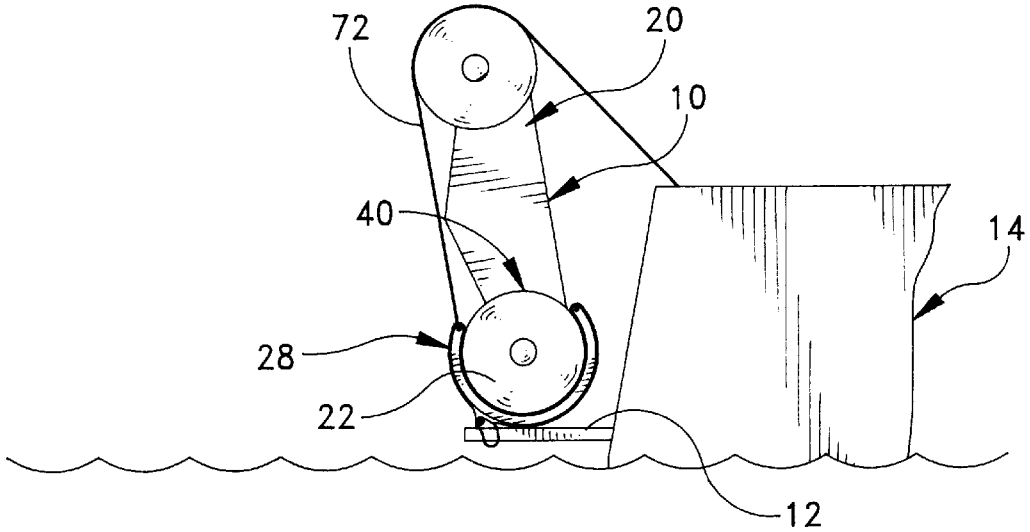
FIG. 4 is a view similar to FIGS. 2 and 3 but shows the inflatable dinghy positioned in the device of the present invention in its final upright storage position.

It should be pointed out that in the first position as shown in FIG. 2, the channel 40 is positioned such that its opening 44, that is, the space between the terminal ends 36 and 38, is directed longitudinally outwardly to receive the pontoon and after being elevated to the upright position shown in FIG. 4 such channel is substantially pointed upward such as to provide adequate support for the inflatable in such position. Also, the depth 46 of the pocket 42 is greater than one half the pontoon portion diameter but less than a full diameter and in this way the pontoon always partially projects from the pocket and thus insures a continual gripping thereon. It should also be pointed out that whereas the invention has been described in the form of a pair of arms 32 and 34, that the channel and pocket 40 and 42 respectively formed by the inner surfaces thereof could be simply configured from a larger generally planar portion or plate of material, that is, a plate in which a generally C-shaped opening in the form and dimensions as above described could be formed therein although the definitive arm structure as above described is preferred in that it uses less material and is, accordingly, lighter, more adaptive in use and less expensive.

Figure 5A:
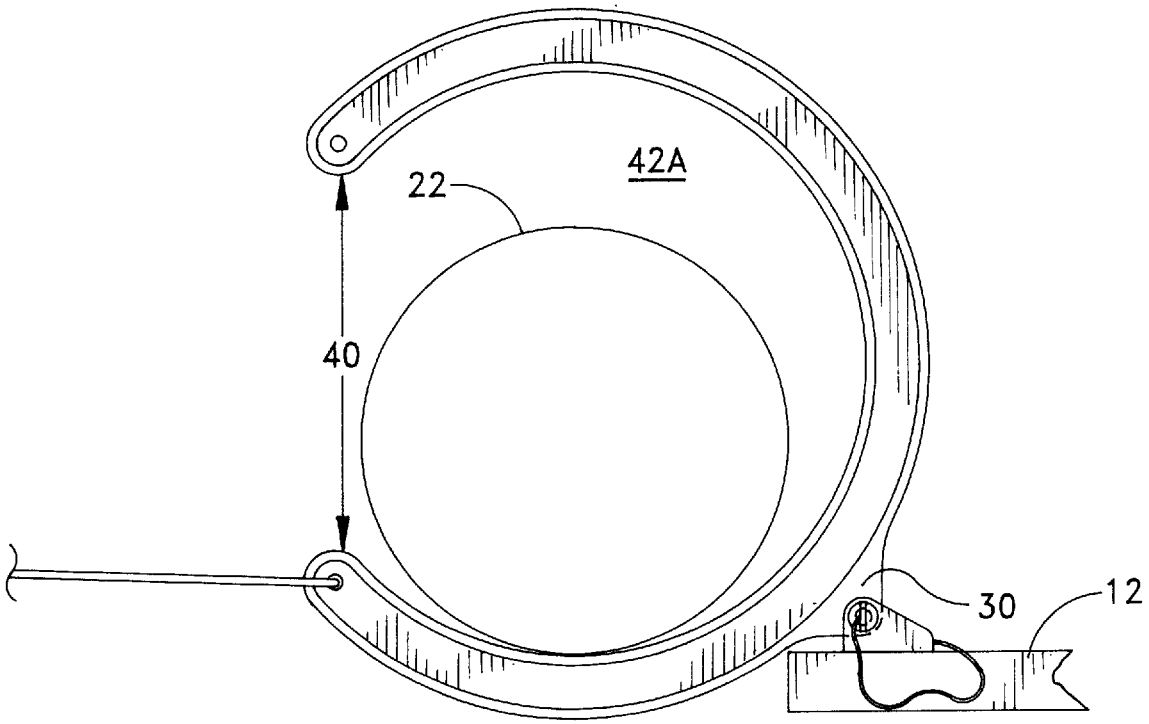
FIG. 5A is a view similar to FIG. 5 but showing a modified form of the invention.
Figure 7:
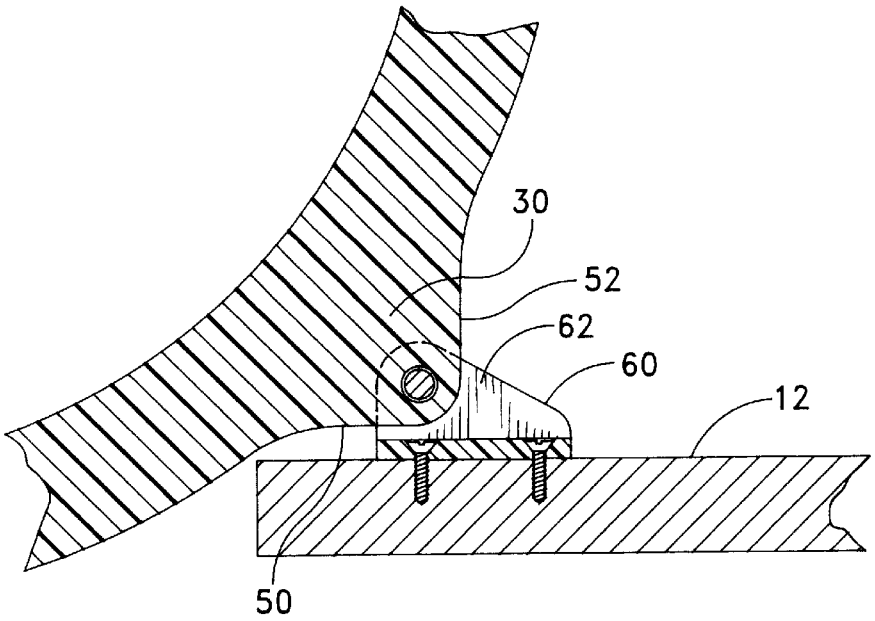
FIG. 7 is a sectional view on an enlarged scale taken along the line 7—7 of FIG. 6.

Referring to FIG. 5A, it should be pointed out that in some cases a pocket 42A of increased dimensions may be utilized both in regard to diameter, e.g., slightly greater than that of the pontoon, and of a depth 46 equal to or slightly greater than that of the pontoon, but even in such cases the opening or channel 40 remains slightly less so that an initial gripping action is at least afforded as the pontoon passes into the pocket 44A.

As best shown in FIGS. 5 through 8, the hoop carriers 28 include as above mentioned a heel or base portion 30 having forward and rearwardly extending flats 50 and 52 and an opening 54 therethrough for the receipt of a pivot pin 56. Each of the hoop carriers 28 is adapted to be pivotally mounted in a bracket 60. Such bracket is of generally U-shaped configuration and includes a base plate 61 and opposed laterally spaced side plates 62 or flanges 62 through which openings 64 extend for receipt of the pivot pin 56 which may be of the locking type and preferably is tied to the bracket by means of a lanyard 66.

In this way then the pivotal movement between the first loading and the second storage position of each of the hoop carriers 28 is accomplished. It should be noted that by reference to FIG. 7 that the forward flat or stop 50 is adapted to engage the upper edge surface of the swim platform 12 although its dimensions can be modified so that a more inwardly extending portion of the forward flat 50, that is, the portion 51, can be arranged to contact the upper surface of the bracket base 61 so as to position the hoop carrier 28 in its forward extending loading position as shown in FIG. 5 with the opening 44 open to the left for receipt of the pontoon. Also, the lower arm 34 is preferably shorter than the upper arm 32 or stated differently, the base 30 of the hoop 28 is more proximate to the lower arm terminus 38 such that the desired pivotal motion places the opening 44 to the left facing the floating pontoon in the first position and locates it upwardly in the carrying or second position. Similarly, the rear flat 52 and the bracket can be similarly configured so that the rear flat contacts the bracket base or alternatively contacts an inboard portion of the upper surface of the swim platform 12 so as to position the hoop carriers in their storage position where the channels are extending in an upright position.

The terminal portions of the lower arms 34 are provided with an opening 70 such that a line 72 may be attached thereto, which line then extends underneath the remaining portion of the inflatable and thence upwardly over the inflatable dinghy to an attachment point at the hull of the larger vessel bearing in mind there are preferably two such lines—one for each of the laterally spaced hoop carriers. In that regard, it should be pointed out that more than two hoop carriers could certainly be utilized but two is sufficient for most purposes. Although one hoop carrier could be utilized for particularly light inflatables, it would be to some extent necessary to pay particular attention to balancing the inflatable with regard to weight distribution and alignment when forcing the inboard pontoon into the pocket.

The lower arm 34 preferably also terminates at its outer point 38 preferably close to the water line WL and is of shorter length or extent than that of the upper arm 32 such that the pivotal or rotational clockwise movement of the hoop carriers 28 can be accomplished. Also, the arms or the carrier itself are preferably formed when made of polypropylene or the like by an injected molding process wherein a body channel or recess 32 is formed on each side surface of the arms and as best shown by the cross-sectional view depicted in FIG. 6 so as to give some increased stiffness to the overall aspect of the carrier, that is, through the I beam-like cross-sectional configuration thereof. The upper arm 34 may also be provided with an opening 78 for general purposes. As a specific example of dimensional characteristics found to be operable with an inflatable dinghy having a pontoon with a 15 inch diameter, the channel 40 was dimensioned, that is, the spacing between the terminal ends 36 and 38, was 13 inches whereas the general diameter of the pocket 42 in which the pontoon was accepted was 15 inches and the depth of the pocket, that is, from an imaginary vertical line between the terminals 36 and 38 to the most inward portion of the pocket 42, was 12 inches. Accordingly, the entire pontoon is not accepted into the pocket but a portion thereof extends outwardly from the channel 40 and in this way reduces the size, weight and extent that the hoop carriers would otherwise require. This is the embodiment shown in FIG. 5.

While there is shown and described herein certain specific structure embodying this invention, it will be manifest to those skilled in the art that various modifications and rearrangements of the parts may be made without departing from the spirit and scope of the underlying inventive concept e.g., while the carrier hoops are described as attached to separate brackets for pivotal movement, such brackets could be inherently formed in the swim platform, vessel hull, etc. so long as the pivotal motion and general attachment was brought about, and that the same is not limited to the particular forms herein shown and described except insofar as indicated by the scope of the appended claims.

What is claimed is:

1. A boat lift and carrier device for inflatable boats of the type having an opposed pair of laterally spaced longitudinally oriented pontoon portions separated by having inboard and outboard pontoon portions of a generally cylindrical configuration having a diametric measurement of a first length, said device including a pair of carrier hoops each mounted in a bracket for pivotal movement with respect to said bracket between a first loading position and a second storage position, said hoops each including an upper and a lower arm and a connecting base portion, said arms outwardly extending from said base portion and terminating in respective forward terminal ends which are spaced from each other a distance slightly less than that of the said pontoon portion first length diametric measurement to form an entrance channel for said pontoon portion, said arms of each hoop cooperatively forming a receiving pocket between said arms and in communication with said entrance channel and of a generally cylindrical configuration and having a diametric measurement of a second length at least equal to that of said first length for receiving said pontoon portions, and means for attaching a line to each of the lower arms so as to pivot said arms about said brackets between said first and second positions after the inboard pontoon portion of said inflatable boat has been positioned in said receiving pockets.

2. The device of claim 1, said receiving pockets each having a depth less than the diametric measurement of the pontoon portions but substantially greater than a measurement equal to one half of such diametric measurement such that the forward ends of the arms continually grip the pontoon portions.

3. The device of claim 1, said hoops generally of a C-shaped configuration.

4. The device of claim 1, said brackets including a pair of upstanding flanges and a connecting base plate, said carrier hoop base portion mounted between said flanges, said hoop base portion having forward and rear stops in turn contacting said bracket base plate at the first and second positions of the carrier hoops.

5. The device of claim 1, said receiving pockets each having a depth at least equal to the diametric measurement of the pontoon portions.

6. The device of claim 1, said lower arm being shorter than said upper arm and wherein said hoop connecting base portion is mounted in a bracket in turn disposed closer to the forward terminus of said lower arm than the forward terminus of said upper arm so that the entrance channel is disposed forwardly in the first position and upwardly in the second position.

* * * * *